US007647731B2

(12) United States Patent
Muir

(10) Patent No.: US 7,647,731 B2
(45) Date of Patent: Jan. 19, 2010

(54) PREFABRICATED MODULAR BUILDING

(75) Inventor: Stephen Muir, Victoria Point (AU)

(73) Assignee: Deployable Structures International Pty Ltd, Victoria Point, Queensland (AU)

( * ) Notice: Subject to any disclaimer, the term of this patent is extended or adjusted under 35 U.S.C. 154(b) by 87 days.

(21) Appl. No.: 11/917,643

(22) PCT Filed: Jun. 9, 2006

(86) PCT No.: PCT/AU2006/000791

§ 371 (c)(1),
(2), (4) Date: Dec. 14, 2007

(87) PCT Pub. No.: WO2006/133482

PCT Pub. Date: Dec. 21, 2006

(65) Prior Publication Data

US 2008/0209820 A1 Sep. 4, 2008

(30) Foreign Application Priority Data

Jun. 16, 2005 (AU) ..... 2005903145

(51) Int. Cl.
*E04H 1/12* (2006.01)
*E04B 1/344* (2006.01)

(52) U.S. Cl. ..... 52/79.5; 52/71; 446/478

(58) Field of Classification Search ..... 52/22, 52/64, 66, 68, 69–71, 79.5; 135/149; 446/478; 229/117.01, 117.07
See application file for complete search history.

(56) References Cited

U.S. PATENT DOCUMENTS 243,873 A * 7/1881 Dorn et al. ..... 446/75
1,386,423 A * 8/1921 Rapson ..... 446/478
2,473,076 A * 6/1949 Scheibner ..... 280/19.1
2,701,038 A * 2/1955 Mooney ..... 52/69
3,341,987 A * 9/1967 Johansson ..... 52/70
3,404,496 A * 10/1968 Ballard ..... 52/64
4,027,912 A * 6/1977 Pacca ..... 296/160
4,633,626 A * 1/1987 Freeman et al. ..... 52/71
4,742,653 A * 5/1988 Napier et al. ..... 52/66
4,779,514 A * 10/1988 Prigmore et al. ..... 52/79.5
4,780,996 A 11/1988 Julien, Jr.
4,912,891 A 4/1990 Bertrand
4,981,919 A * 1/1991 Mayska et al. ..... 525/390
5,269,106 A 12/1993 Stafford et al.

(Continued)

FOREIGN PATENT DOCUMENTS

AU 6209986 3/1987

(Continued)

*Primary Examiner*—Robert J Canfield
(74) *Attorney, Agent, or Firm*—Kirton & McConkie; Evan R. Witt

(57) ABSTRACT

A prefabricated building module includes a rectangular floor structure, three walls and a trussed roof structure enclosing a ceiling space with two end walls pivoted about the short sides of the floor structure, the third wall pivoted at its lower end to a long side of the floor structure and the roof structure pivoted at the upper end of said side wall such that said walls and roof structure fold onto the floor structure to form a flat pack with the same footprint as the floor structure. The roof structure comprises a ceiling and upright roof trusses pivoted to the ceiling which fold down within the plan of the roof and the walls have provision for doors and windows.

8 Claims, 6 Drawing Sheets

U.S. PATENT DOCUMENTS

| | | | | |
|---|---|---|---|---|
| 5,444,944 | A * | 8/1995 | Roelofsz | 52/64 |
| 5,493,818 | A | 2/1996 | Wilson | |
| 5,596,844 | A * | 1/1997 | Kalinowski | 52/79.5 |
| 5,660,005 | A * | 8/1997 | Tacoma | 52/93.2 |
| 6,253,498 | B1 * | 7/2001 | Fanucci | 52/69 |
| 6,564,513 | B2 | 5/2003 | Henbid et al. | |
| 6,948,280 | B2 * | 9/2005 | Marcinkowski et al. | 52/79.1 |
| 6,983,567 | B2 * | 1/2006 | Ciotti | 52/79.5 |
| 7,177,645 | B2 * | 2/2007 | Goldhamer | 455/447 |
| 2003/0140573 | A1 * | 7/2003 | Marcinkowski et al. | 52/79.5 |
| 2005/0044804 | A1 * | 3/2005 | Bin et al. | 52/79.5 |
| 2006/0043090 | A1 * | 3/2006 | Ferrini | 220/6 |

FOREIGN PATENT DOCUMENTS

| | | |
|---|---|---|
| DE | 2815848 | 10/1978 |
| DE | 20102126 | 3/2001 |
| GB | 2225358 | 5/1990 |
| JP | 090004058 | 1/1997 |
| RU | 1803507 | 3/1993 |
| RU | 2240400 C1 | 11/2004 |
| WO | 96/13402 | 5/1996 |
| WO | 2006051208 | 5/2006 |

* cited by examiner

PREFABRICATED MODULAR BUILDING

FIELD OF INVENTION

This invention relates to modular building units which are prefabricated and transported to location where they are erected to provide accommodation.

BACKGROUND OF THE INVENTION

There are many prior art documents disclosing different methods for achieving prefabricated accommodation. RU2240400 describes a shipping container-like structure which concertinas into a flat package for transportation. When erected It constitutes an extremely rudimentary box shaped structure.

WO 96/13402 shows a more sophisticated folding structure pivoted to a central unit provided with wheels for transportation. When on location supporting bearers extend from the central unit and additional modules unfold from either side of the central unit to sit on the bearers. The side modules have gabled roofs and end walls fold out from the sides of the central unit to form closed structures. This construction is costly and only suitable for transportation by towing behind a prime mover.

U.S. Pat. No. 4,780,996 teaches a folding portable building construction with a rigid central section and a winching system for the erection of roof members of complementary side modules. Wall members and flooring unfold after the roof members are winched into place. The winching system can be removed after erection which makes the system independent of erecting cranes but adds to the cost.

SU1803507 and U.S. Pat. No. 4,912,891 teach further variations on the theme of a rigid central unit with unfolding side modules. However this rigid central unit construction is bulky and difficult to transport. Accordingly there is a need for a prefabricated building which can be transported as a flat package like that of RU2240400 but which provides more habitable accommodation when erected on location.

OBJECT OF THE INVENTION

It is therefore an object of the present invention to provide a prefabricated modular building which lends itself to efficient transportation and which is simply erected into habitable accommodation or which at least provides an alternative to prior art systems.

STATEMENT OF THE INVENTION

According to the present invention, a prefabricated building module comprises a rectangular floor structure with two end walls pivoted about the short sides of the floor structure, a side wall pivoted at its lower end to a long side of the floor structure and a roof structure pivoted at the upper end of said side wall such that said walls and roof structure fold into a flat pack to facilitate transport of the module.

Preferably the roof structure comprises a ceiling and upright roof trusses pivoted to the ceiling which fold down onto the ceiling for transport.

Preferably the end walls fold down onto the floor, the ceiling folds down onto the side wall, the trusses fold down onto the ceiling and the ceiling folds down onto the end walls to form a flat pack.

Preferably the walls, the ceiling structure and the roof trusses have mechanisms which lock them in place when erect.

Preferably the walls have provision for doors and windows.

Preferably the roof is formed from a flexible membrane which is held in sail tracks attached to the roof trusses.

Preferably the module is adapted to be used in combination with other modules to form habitable buildings of two or more modules.

Alternatively the roof structure comprises rigid batten construction.

Preferably the floor and roof structure are adapted to extend beyond the building alignment to form external verandahs.

Alternatively a method is provided whereby the roof structure and the walls of a prefabricated building fold down sequentially onto the floor structure of the building to form a flat pack for transport.

Alternatively a roof structure comprises upright roof trusses which fold down to facilitate transport and a flexible membrane which is held in sail tracks attached to the roof trusses.

DETAILED DESCRIPTION OF THE INVENTION

Figure 1A:
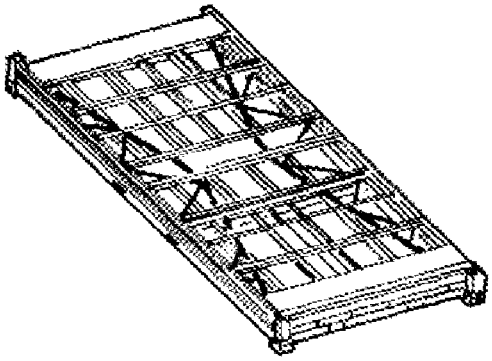
FIGS. 1*a* to *e* show perspective views of a prefabricated building module in its various stages of erection from a flat pack to a fully erect structure.
Figure 1B:
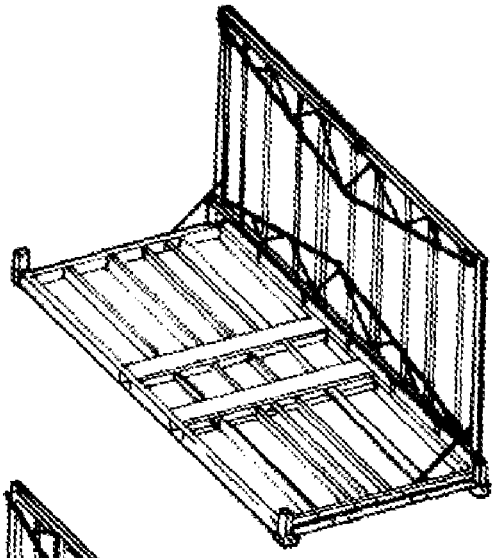
Figure 1C:
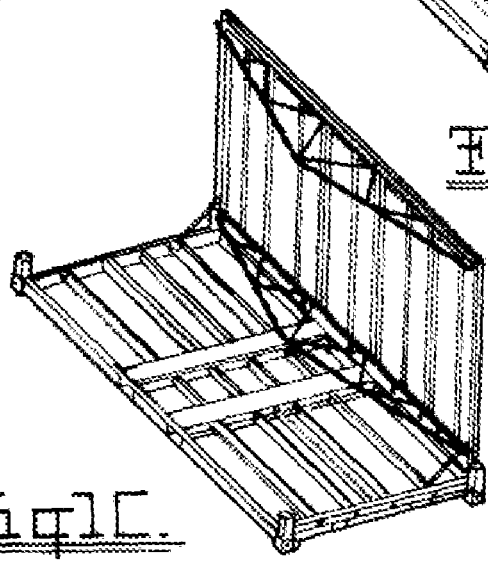
Figure 1D:
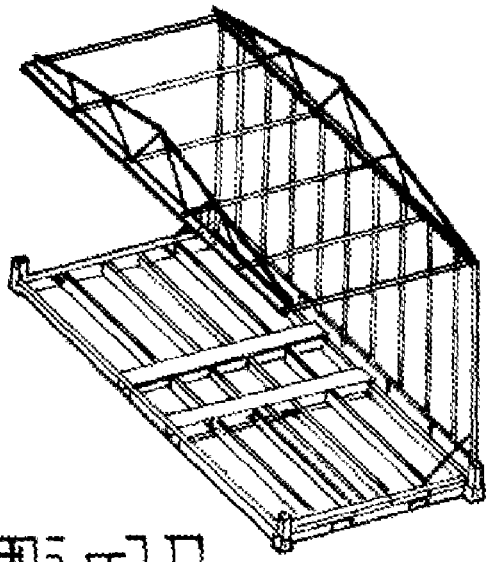
Figure 1E:
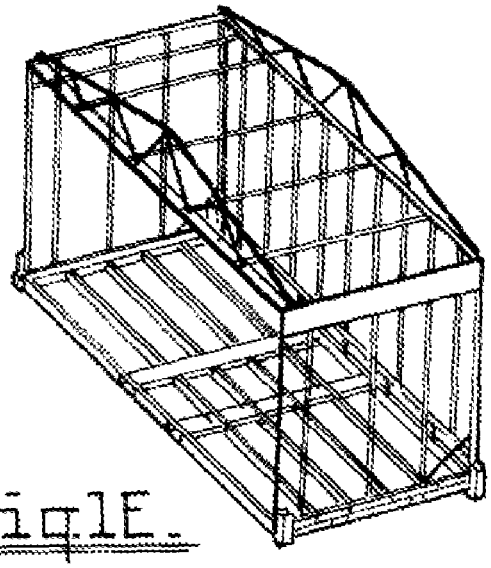
Figure 2:
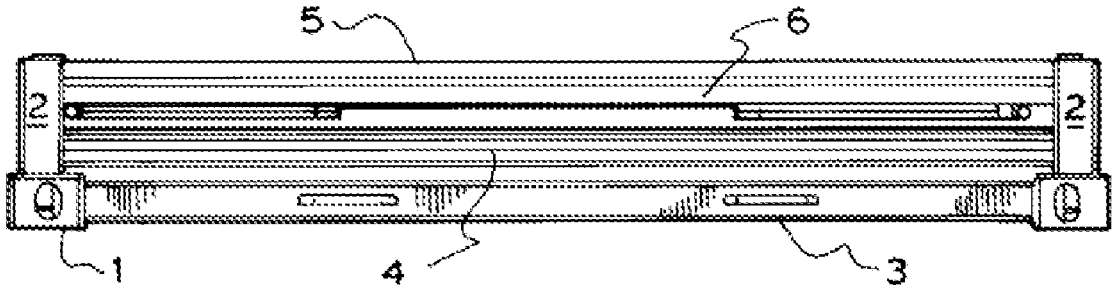
FIG. 2 is a side elevation of the flat pack in FIG. 1*a*

The prefabricated building modules of the present invention are transported as a flat pack 1 illustrated in FIG. 1*a* and 2, with the same plan dimensions as a shipping container and with corner post stubs 2 to facilitate stacking. The floor 3 of the module forms the base of pack 1 and end walls 4, side wall 5 and roof structure 6 are folded into flat pack 1.

Figure 3:
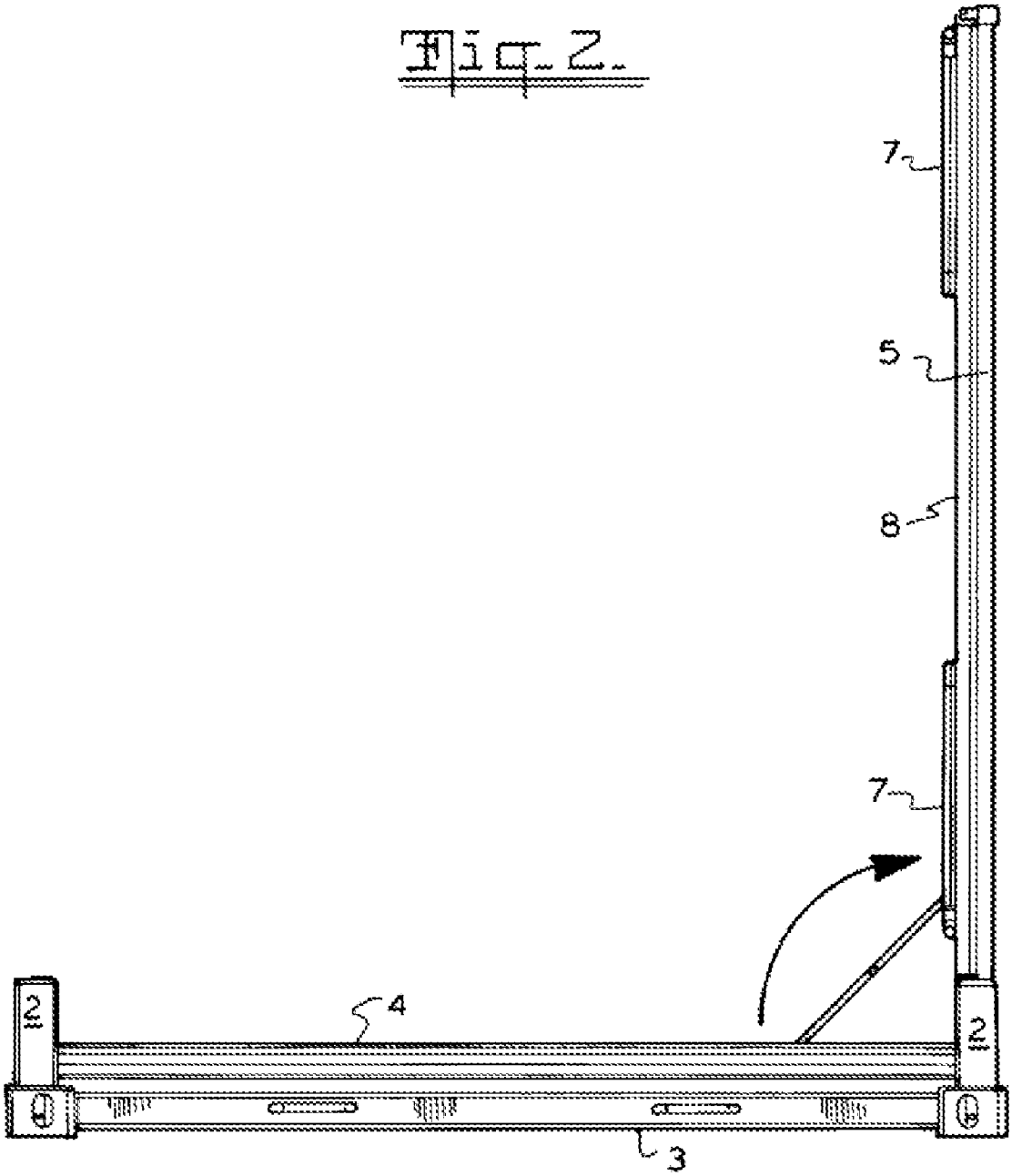
FIG. 3 is a side elevation of the first stage of erection in FIG. 1*b*
Figure 4:
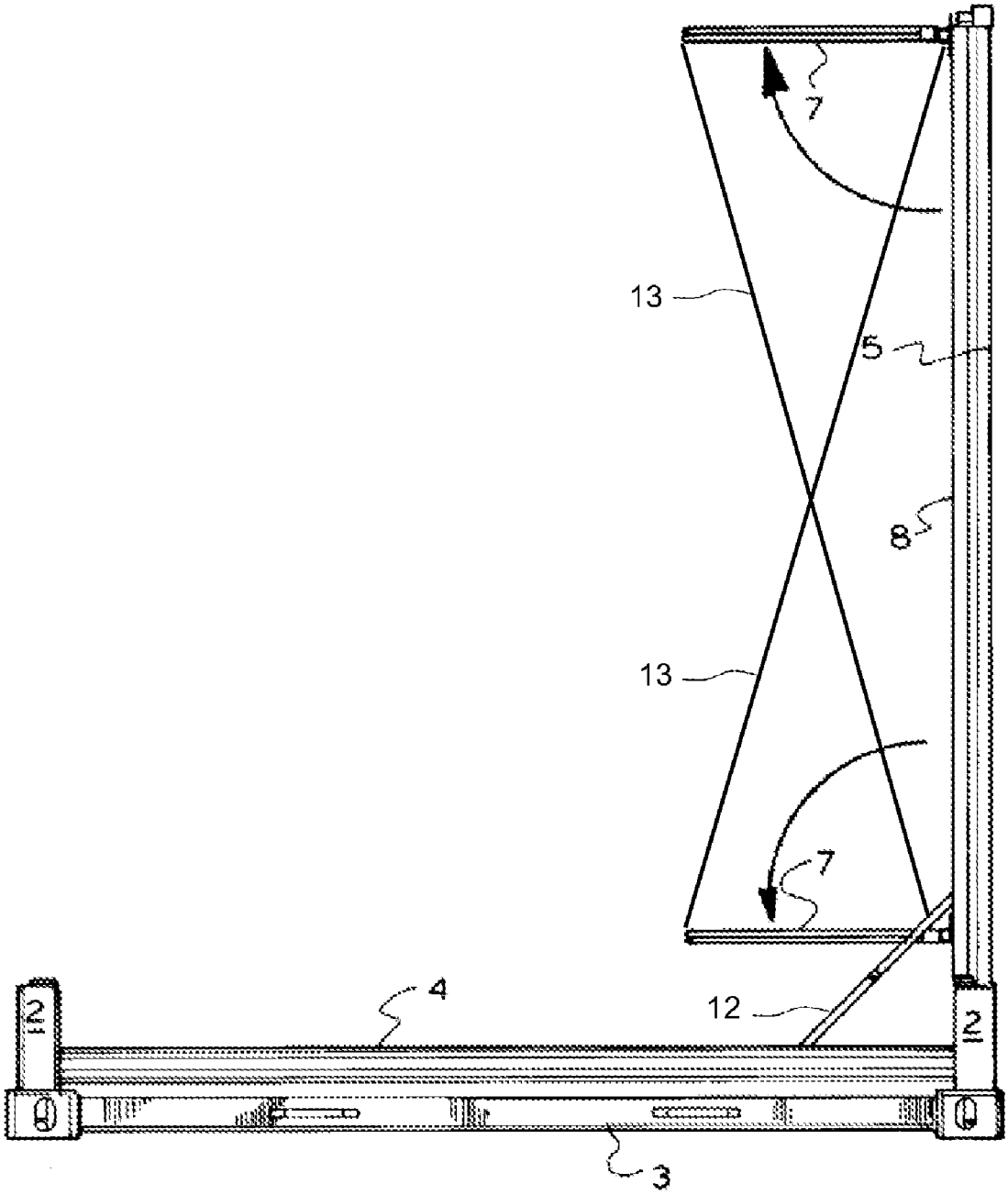
FIG. 4 is a side elevation of the second stage of erection in FIG. 1*c*
Figure 7:
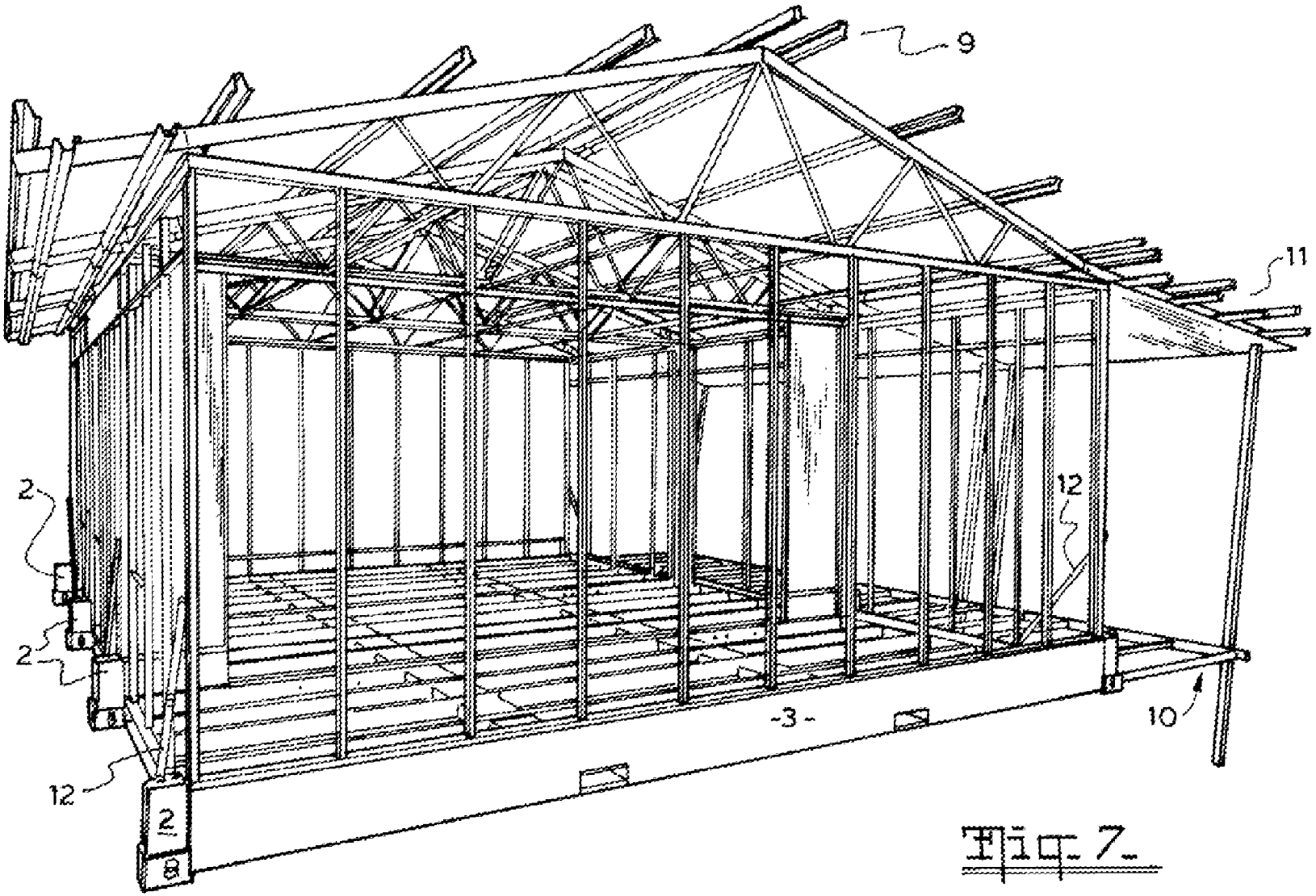
FIG. 7 is a perspective view of two modules joined to form a building which has a rigid roof structure.

In the first stage of erection of the module shown in FIG. 3, side wall 5 which is pivoted to floor 3 at its inner lower end and ceiling 8 which is pivoted at the inner upper end of wall 5, are rotated up out of pack 1 and wall 5 is locked in its vertical position by means of locking struts 12, shown in FIG. 7. In the second stage shown in FIG. 4, roof trusses 7 are rotated out of the plane of ceiling 8 and locked in position at right angles to ceiling 8 by locking struts 13.

Figure 5:
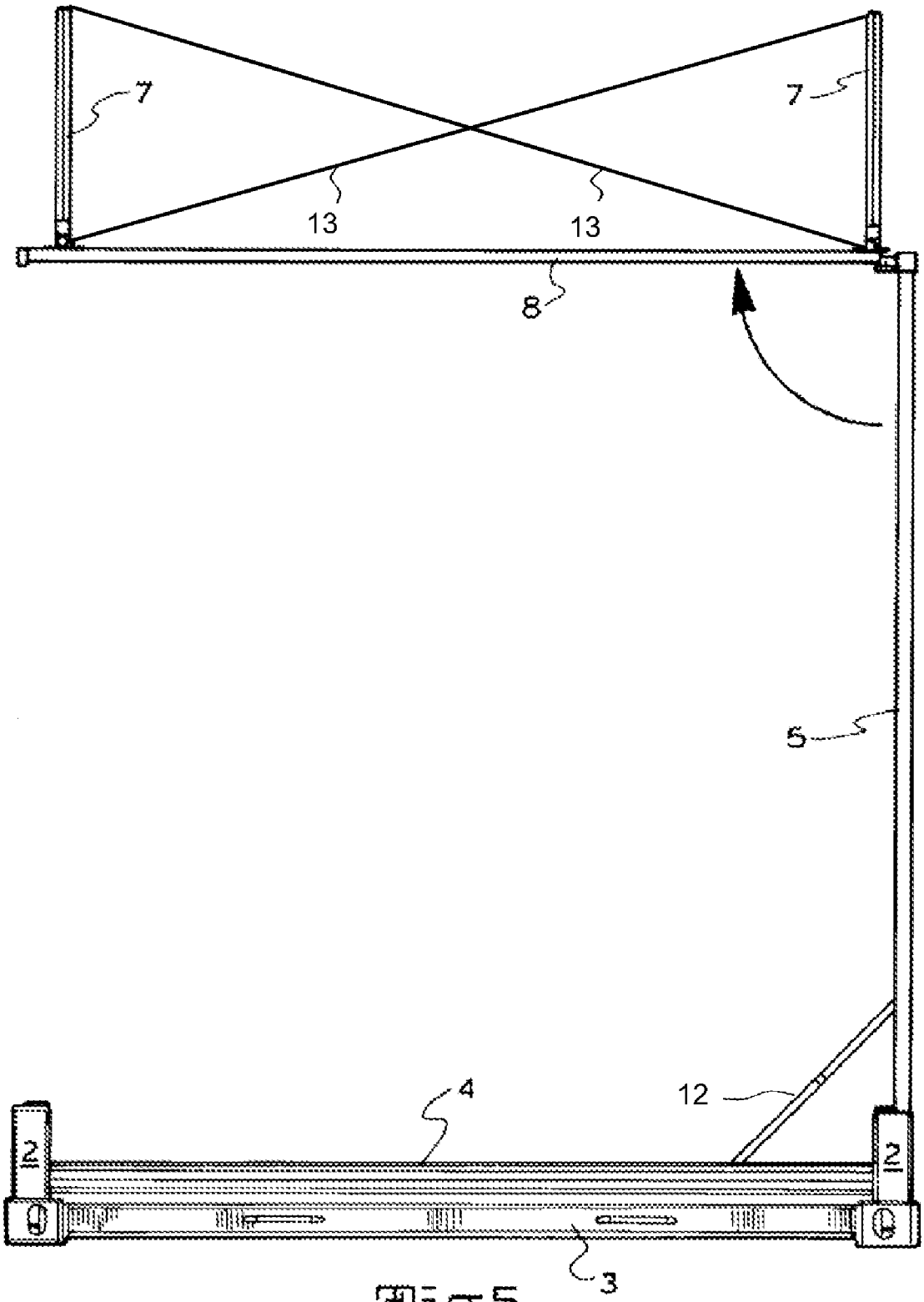
FIG. 5 is a side elevation of the third stage of erection in FIG. 1*d*
Figure 6:
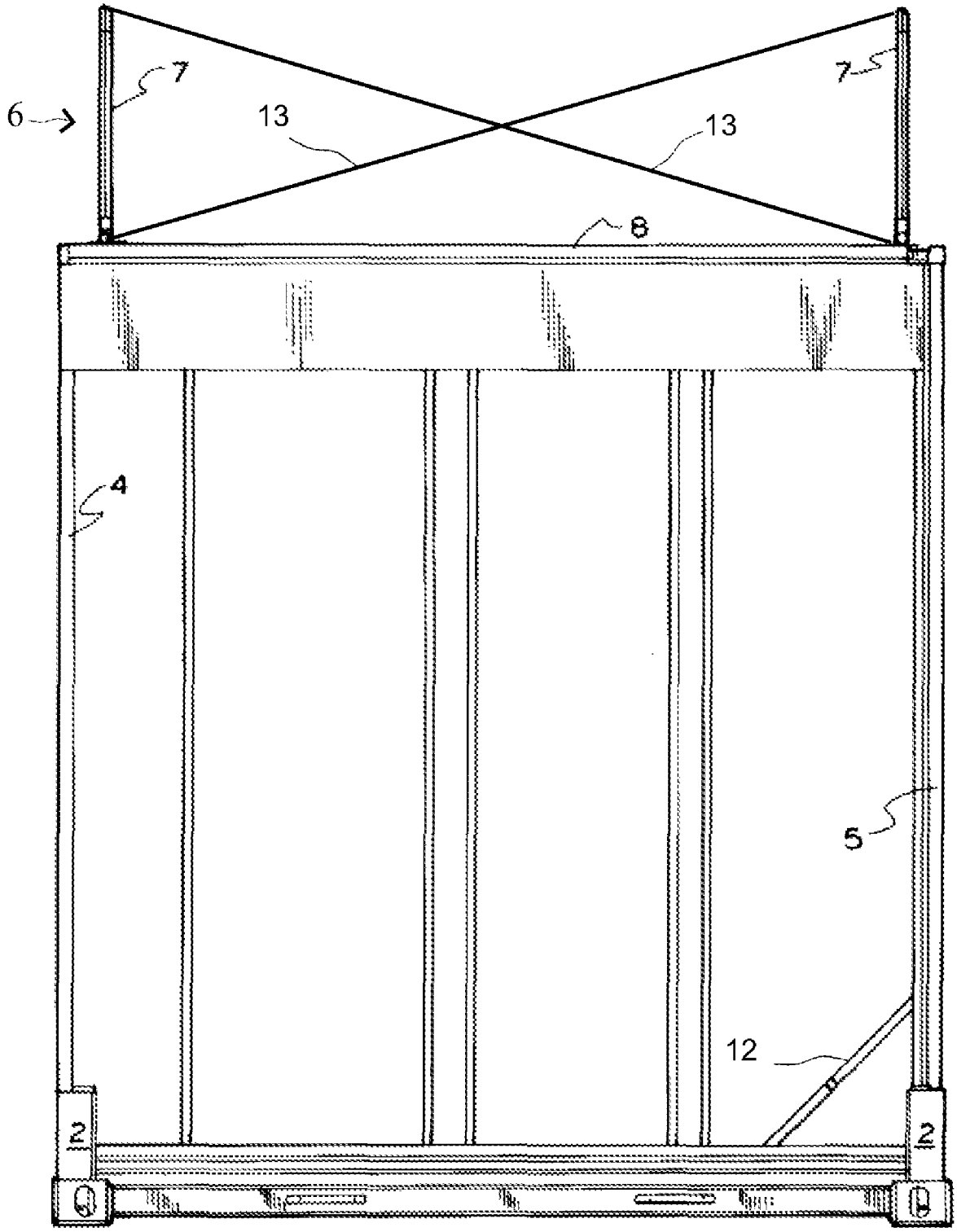
FIG. 6 is a side elevation of the fully erect structure of FIG. 1*e*

In the third stage of erection shown in FIG. 5, ceiling 8 is raised to its horizontal position with roof trusses 7 vertical and held in place by locking struts 13. An auxiliary winch pole (not shown) attaching to the floor structure midway along the outside of wall 5 may be used to raise ceiling 8. In the final stage shown in FIG. 6, end walls 4 which are pivoted to floor 3 are rotated into their vertical positions and lock in place to support roof structure 6.

Accordingly the erected module is structurally self supporting and two modules can be joined at their open ends to form a habitable structure with a plan area of two shipping containers as shown in FIG. 7. Roof covering may be provided by drawing a sail type membrane through sail tracks attached to trusses 7 and sealing the join between the two modules with a ridge cap.

Alternatively a conventional rigid roof structure 9 may be provided as shown in FIG. 7. An outdoor verandah may be provided by extensions 10 to floor 3 beyond the module alignment and extensions 11 to roof structure 9 may also be provided to cover the outdoor verandah.

Walls 4 and 5 are clad with a building material of structural and thermal ratings appropriate to the location. Doors and windows are provided as required and three or more modules can be joined simply by eliminating one or more internal side walls of the modules. The buildings so formed can be used in a variety of applications including living and working accommodation and military uses such as field headquarters and hospitals.

The sail type roof structure of the module can also be used independently to provide a roof over, for example, a shipping container. Roof trusses 7 can be pivoted to the top of the container just as they are to ceiling structure 8, rotated from their stowed position and locked in their erect position. A shade membrane can then be drawn into place through sail tracks attached to trusses 7 thus forming a roof over the container.

VARIATIONS

It will be realized that the foregoing has been given by way of illustrative example only and that all other modifications and variations as would be apparent to persons skilled in the art are deemed to fall within the broad scope and ambit of the invention as herein set forth. For example various mechanical equivalents could be substituted for pivoting and locking components without departing from the inventive concept.

Throughout the description and claims to this specification the word "comprise" and variation of that word such as "comprises" and "comprising" are not intended to exclude other additives components integers or steps.

The invention claimed is:

1. A prefabricated building module including a rectangular floor structure, three walls and a trussed roof structure enclosing a space;

the three walls comprised of two end walls pivoted about 90 degrees about the short sides of the floor structure, and a side wall pivoted about 90 degrees at its lower end to a long side of the floor structure; and the roof structure pivoted about 90 degrees at the upper end of said side wall such that said walls and roof structure fold onto the floor structure to form a flat pack within the same footprint of the floor structure.

2. The module of claim 1 in which the roof structure comprises a ceiling and upright roof trusses pivoted about 90 degrees to the ceiling which fold down onto the ceiling to form a flat pack within the same footprint of the floor structure.

3. The module of claim 2 in which the end walls fold down onto the floor, the ceiling folds down onto the third wall, the trusses fold down onto the ceiling and the combination of trusses, ceiling and third wall folds down onto the end walls to form a flat pack within the same footprint of the floor structure.

4. The module of claim 2 in which the walls, the ceiling and the roof trusses have mechanisms which lock them in place when erect.

5. The module of claim 1 in which the walls have provision for doors and windows.

6. The module of claim 1 which is adapted to be used in combination with other modules to form habitable buildings of two or more modules.

7. The module of claim 1 in which the roof structure comprises rigid batten construction.

8. The module of claim 1 in which the floor and roof structure are adapted to form an external verandah.

* * * * *